US007369034B2

(12) United States Patent
Kambara

(10) Patent No.: US 7,369,034 B2
(45) Date of Patent: May 6, 2008

(54) CHIP VARIABLE RESISTOR

(75) Inventor: Shigeru Kambara, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 62 days.

(21) Appl. No.: 10/555,730

(22) PCT Filed: May 7, 2004

(86) PCT No.: PCT/JP2004/006483

§ 371 (c)(1),
(2), (4) Date: Nov. 7, 2005

(87) PCT Pub. No.: WO2004/100188

PCT Pub. Date: Nov. 18, 2004

(65) Prior Publication Data

US 2007/0001800 A1 Jan. 4, 2007

(30) Foreign Application Priority Data

May 8, 2003 (JP) ..... 2003-130296

(51) Int. Cl.
*H01C 1/012* (2006.01)

(52) U.S. Cl. ..... 338/307

(58) Field of Classification Search ..... 338/307
See application file for complete search history.

(56) References Cited

U.S. PATENT DOCUMENTS 3,413,588 A * 11/1968 Ferrell ..... 338/174
4,465,994 A * 8/1984 Rehberger ..... 338/164
4,721,940 A * 1/1988 Otani ..... 338/163

FOREIGN PATENT DOCUMENTS

| | | |
|---|---|---|
| JP | 54-98549 | 7/1979 |
| JP | 5-33502 | 4/1993 |
| JP | 05243019 A * | 9/1993 |
| JP | 7-147206 | 6/1995 |
| JP | 11-297517 | 10/1999 |
| JP | 2000-124011 | 4/2000 |

* cited by examiner

*Primary Examiner*—Elvin Enad
*Assistant Examiner*—Joselito Baisa
(74) *Attorney, Agent, or Firm*—Hamre, Schumann, Mueller & Larson, P.C.

(57) ABSTRACT

A chip variable resistor which is capable of keeping the resistance at an adjusted value and can be manufactured easily is provided.

An insulating substrate is formed with a through-hole capable of receiving a driver, and the upper surface of the insulating substrate is formed with a resistor film surrounding the through-hole. A rotor in the form of a circular plate overlaps the resistor film via a spacer made of an insulating material. The rotor is pressed and held from the outside by a holder made of a metal plate. The spacer is partially cut away so that a contact portion of the rotor is exposed downward for coming into contact with the resistor film. Since the holder surrounds the rotor from the outside, the resilient force of the holder can strongly act on the rotor. Therefore, the resistance can be reliably kept at the adjusted value.

7 Claims, 9 Drawing Sheets

CHIP VARIABLE RESISTOR

BACKGROUND OF THE INVENTION

The present invention relates to a chip variable resistor.

A chip variable resistor includes, as essential structural parts, an insulating substrate having an upper surface formed with a resistor film in the form of a strip, while also including a rotor having a contact portion to come into contact with the resistor film. The resistance is adjustable by moving the contact portion of the rotor in the longitudinal direction of the resistor film.

Conventionally, as disclosed in e.g. JP-A-11-297517 as prior art, the insulating substrate is formed with a center hole vertically penetrating the substrate, and the rotor is made of a metal plate into a bowl-like shape opening upward. The terminal plate arranged on the lower surface of the insulating substrate is provided with a center cylinder fitted into the center hole and extending upward while penetrating through the rotor. By spreading the upper end of the center cylinder by crimping, the rotor is held in a rotatable manner, and the terminal plate is held not to drop from the insulating substrate.

Further, the terminal plate includes an electrode (center electrode) formed by bending the plate and exposed to the outside of the insulating substrate. The resistor film is horseshoe-shaped in plan view, including an arcuate portion surrounding the center hole of the insulating substrate. The insulating substrate is provided with a first electrode electrically connected to one end of the resistor film and a second electrode electrically connected to the other end of the resistor film.

The rotor overlaps the insulating substrate at a portion inward of the arcuate portion of the resistor film and includes a contact portion projecting downward for contact with the arcuate portion of the resistor film. The rotor is formed with an engagement hole in the form of a cross or a bar into which a driver for operating the rotor for rotation is to be fitted.

The dimensions of the chip variable resistor are set so that the length of one side is no more than 2 mm, for example. Since both of the rotor and the terminal plate need be processed into complicated configurations according to the structure of the prior art, the processing tends to take much time and can be troublesome.

Further, in accordance with the size reduction of electronic devices in recent years, further size reduction of a chip variable resistor is demanded. However, with the structure in which a cylindrical portion is formed at the terminal plate and crimped for fixation to the insulating substrate, there is a limit on the size reduction because of the problems related to the technique of sheet metal working, which provides a limit on the size reduction of a chip variable resistor.

Moreover, in the prior art structure, the rotor is merely pressed and held by the crimped portion of the center cylinder. When the center cylinder or the rotor is worn out at the crimped portion due to the rotation of the rotor, the force to press and hold the rotor by the crimped portion of the center cylinder is considerably reduced. In this case, the rotor may rotate in a subsequent processing step, thereby causing the resistance to deviate from the desired value, or the resistance may fail to be readjustable.

Some of the printed boards on which a chip variable resistor is to be mounted are formed with a through-hole, and there is a demand for the structure which enables the adjustment of the resistance also from the reverse side of the printed board. However, with the prior art structure in which the rotor is attached to the insulating substrate by crimping, the rotational operation of the rotor is possible only from the obverse side of the printed board. Therefore, the structure cannot meet the above demand and lacks adaptability.

DISCLOSURE OF THE INVENTION

An object of the present invention is to improve the inconvenience described above.

A chip variable resistor according to the present invention is similar to the prior art structure in that the resistor includes an insulating substrate having an upper surface formed with a resistor film in the form of a strip, and a rotor overlapping the insulating substrate from above. However, as the characteristic structure, the resistor of the present invention includes a holder for pressing the rotor from an outside horizontally rotatably.

The resistor film has a non-linear configuration including an arcuate portion surrounding the rotation center of the rotor and a first and a second ends extending toward an edge of the insulating substrate. The rotor includes a contact portion for contact with the resistor film and an engagement portion to which a driver for rotational operation is to be fitted. The rotor is so held that only the contact portion come into contact with the resistor film.

The resistor further comprises a first electrode electrically connected to the first end of the resistor film, a second electrode electrically connected to the second end of the resistor film, and a third electrode electrically connected to the rotor. The first, the second and the third electrodes are exposed to the outside at a peripheral surface of the insulating substrate.

It is to be noted that "generally circular" in the present invention indicates all the configurations that can rotate while being held by the holder from the radially outside, and it is only required that the configuration can have a circumscribed circle. Therefore, the concept includes a circle which is partially cut away and regular polygons, for example.

With the structure in which the holder presses the rotor from the outside like the present invention, the rotor and the holder can have a simple configuration and need not be processed into a complicated configuration. Therefore, the trouble of processing can be reduced, and the size reduction is easier than the prior art structure.

Further, as compared with the crimping technique of the prior art structure, the contact area between the holder and the rotor is considerably increased. Therefore, even after the rotor is rotated, the rotor can be reliably pressed and held by utilizing the resilient force of the holder. Therefore, it is possible to prevent the resistance from fluctuating due to the rotation of the rotor and to prevent the readjustment of the resistance from becoming impossible after the resistance is once adjusted.

In Claim 2 of the present invention, the holder comprises a conductive metal plate and includes at least a pair of holding portions extending to a lower surface of the insulating substrate for attaching the holder to the insulating substrate and pressing and holding the rotor, and the holding portions serve as the third electrode.

With the structure of Claim 2, additional provision of a third electrode is unnecessary. Therefore, the structure can be simplified, and the manufacturing cost can be reduced.

In Claim 3 of the present invention, the rotor comprises a conductive metal plate having a flat configuration and arranged to overlap the arcuate portion of the resistor film in plan view. A spacer made of an insulating material intervenes between the rotor and the resistor film so that only the contact portion of the rotor comes into contact with the resistor film.

With the structure of Claim 3, the rotor can have a simple configuration like a flat plate, and hence, can be manufactured easily.

In Claims 4 and 5 of the present invention, the engagement portion of the rotor comprises an engagement hole in the form of a cross or a bar in plan view, and the insulating substrate is formed with a through-hole for allowing insertion of a driver for rotational operation of the rotor from both of upper and lower sides.

With the structure of Claims 4 and 5, when the resistor is mounted to a printed board formed with a through-hole, the adjustment of the resistance can be performed from both of the obverse and the reverse sides of the printed board by aligning the through-hole of the insulating substrate with the through-hole of the board, and it is unnecessary to turn over the printed board for the adjustment of the resistance. Therefore, the process step to adjust the resistance and another step to be performed before or after the adjustment step or simultaneously with the adjustment step can be performed efficiently, so that the manufacturing efficiency of a printed-board can be enhanced.

In Claims 6 through 8 of the present invention, each of the first and the second electrodes is made of a conductive metal plate into a configuration for clamping an edge of the insulating substrate from above and below.

In the prior art chip variable resistor, the electrode electrically connected to an end of the resistor film is generally formed by applying conductive paste, drying and baking the paste and then plating, which is troublesome because of the large number of process steps. With the structure of Claims 6 through 8, however, the electrode made of a metal plate is mounted just by fitting, whereby the manufacturing process can be simplified and the manufacturing cost can be reduced.

BRIEF DESCRIPTION OF THE DRAWINGS

FIG. 2B is a plan view taken along lines B-B in FIG. 2A.

FIG. 2C is a plan view taken along lines C-C in FIG. 2A.

FIG. 2D is a plan view taken along lines D-D in FIG. 2A.

FIG. 2E is a plan view taken along lines E-E in FIG. 2A.

BEST MODE FOR CARRYING OUT THE INVENTION

(1). First Embodiment (FIGS. 1-6)

Figure 1:
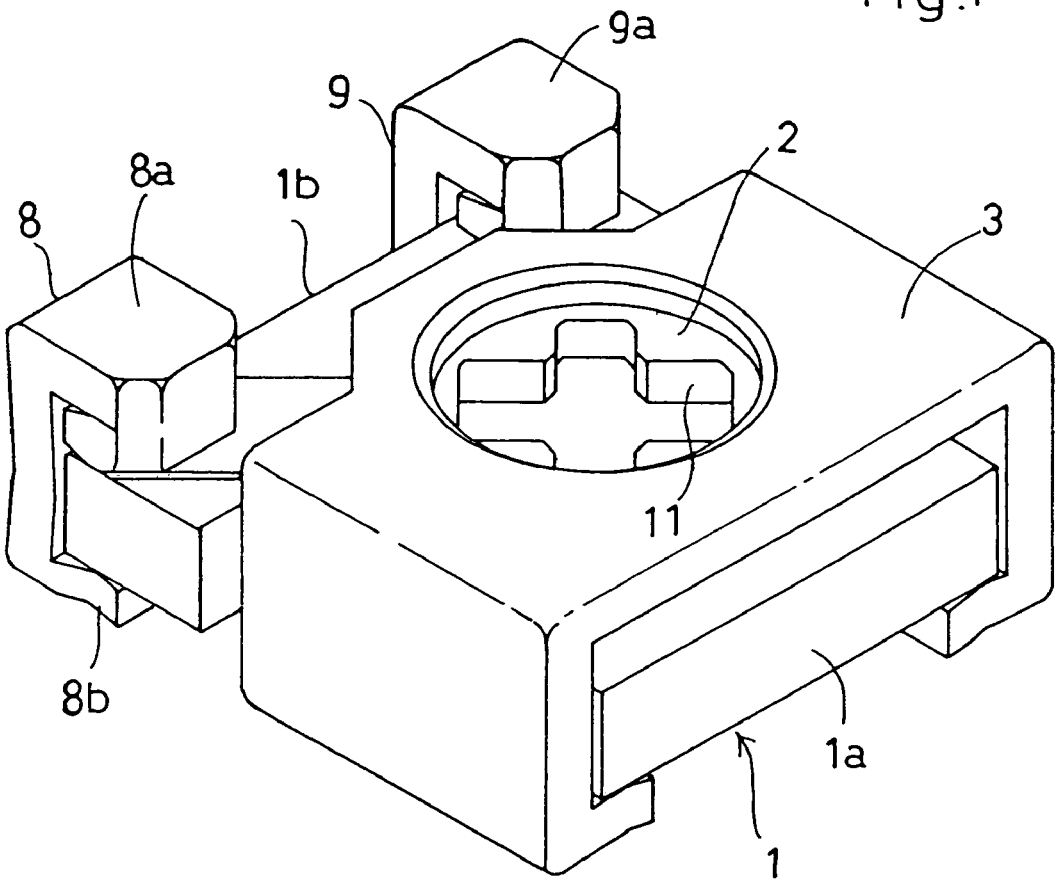
FIG. 1 is a perspective view of a first embodiment.
Figure 2A:
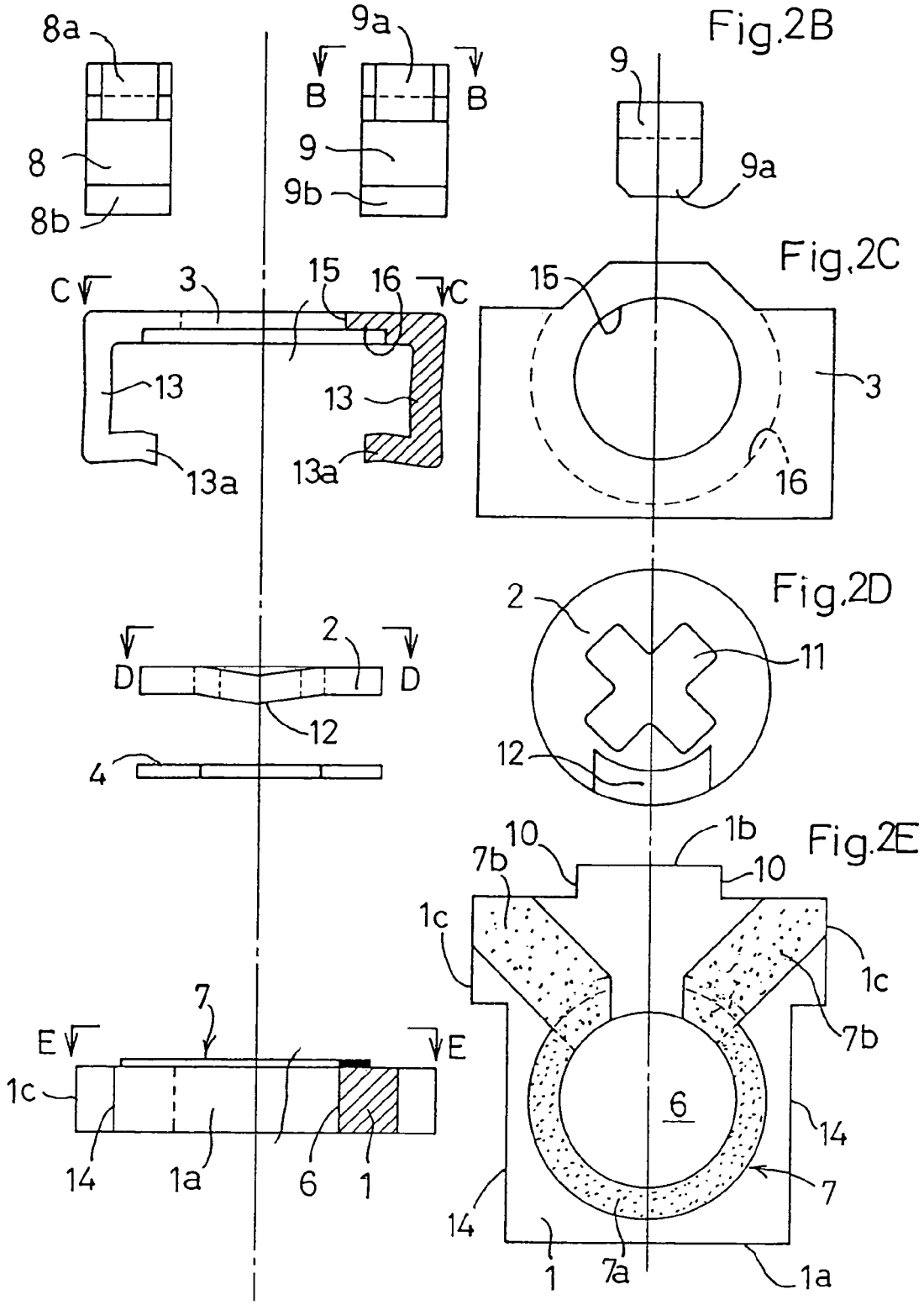
FIG. 2A is an exploded front view.
Figure 3:
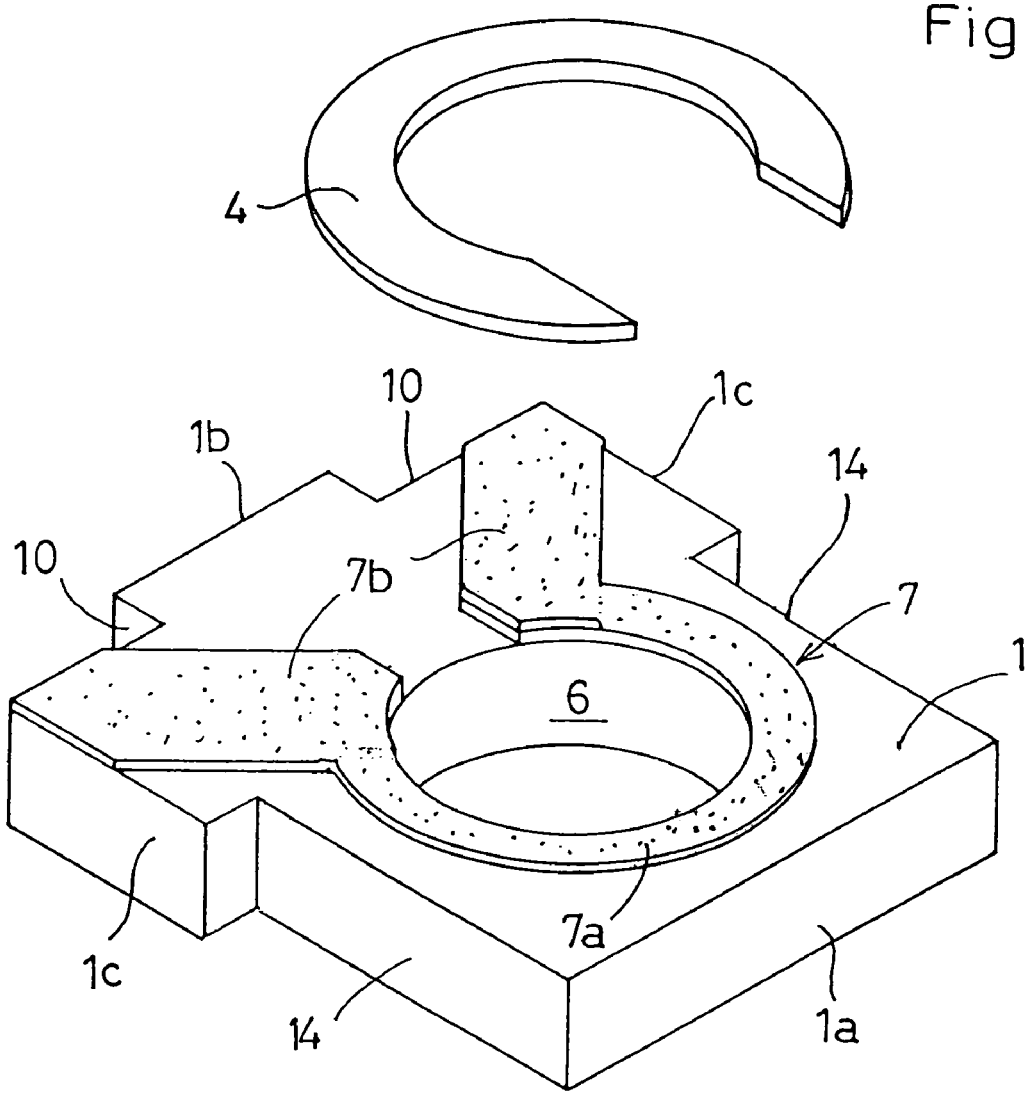
FIG. 3 is an exploded perspective view showing an insulating substrate and a spacer.

A chip variable resistor comprises an insulating substrate 1 made of an insulating inorganic material such as alumina ceramic, a rotor 2 which is circular in plan view and overlaps the substrate 1 from above, a holder 3 pressing and fixing the rotor 2 to the insulating substrate 1 in such a manner that the rotor 2 is rotatable, and a spacer 4 intervening between the rotor 2 and the insulating substrate 1.

The insulating substrate 1 is basically quadrilateral and formed, at a position slightly offset toward a first side surface 1*a*, with a through-hole 6 which is open at an obverse and a reverse surfaces, and which has a size capable of allowing the insertion of a driver 5 to operate the rotor 2 for rotation.

The upper surface of the insulating substrate 1 is formed with a resistor film 7 in the form of a strip made up of an arcuate portion 7*a* surrounding the through-hole 6 and two linear portions 7*b*. The linear portions 7*b* of the resistor film 7 extend diagonally toward the corners on the opposite side from the first side surface 1*a* of the insulating substrate 1. The portions of the insulating substrate 1 at which the ends of the resistor film 7 are positioned are clamped, from above and below, by a first and a second electrodes 8 and 9 made of metal.

Figure 4:
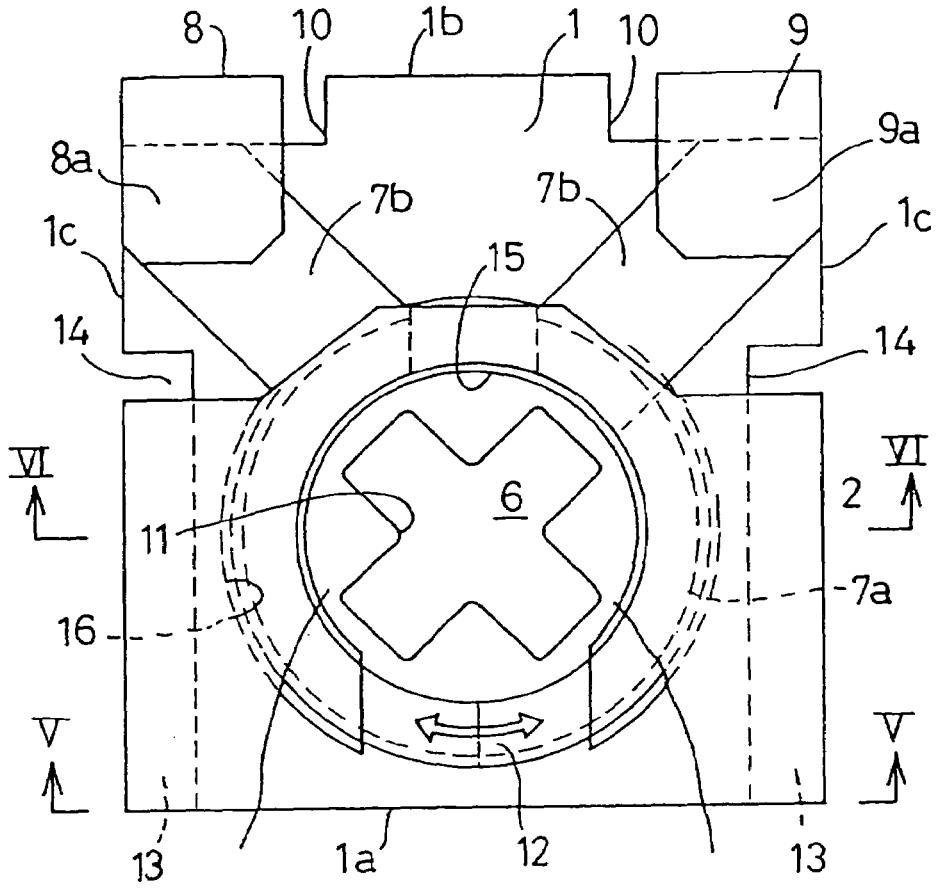
FIG. 4 is a full plan view.
Figure 5:
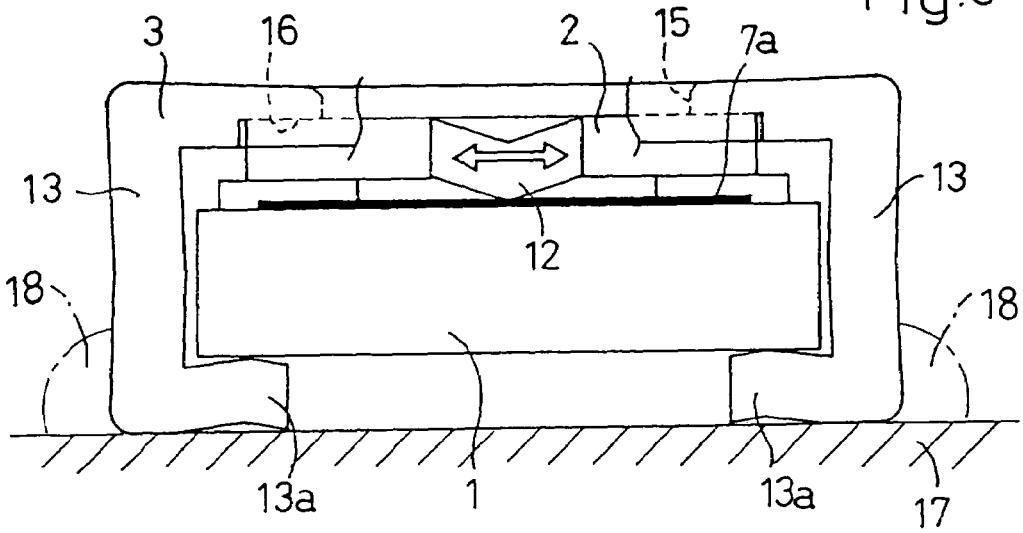
FIG. 5 is a front view taken along lines V-V in FIG. 4.

The two electrodes 8 and 9 are fitted to the insulating substrate 1 from the direction of the second side surface 1*b* which is opposite from the first side surface 1*a*. The second side surface 1*b* is formed with first cutouts 10 having a depth which is generally equal to the plate thickness of the electrodes 8 and 9. Therefore, the side surface 1*b* of the insulating substrate 1 and the rear surfaces of the electrodes 8 and 9 are generally flush with each other. As shown in FIG. 4, the width of the first cutouts 10 is slightly larger than that of the electrodes 8 and 9. The electrodes 8 and 9 have upper lateral pieces 8*a* and 9*a* each of which is folded into two.

The rotor 2 includes a cross-shaped engagement hole 11 into which the driver 5 is to be fitted.

The rotor 2 is formed with a cross-shaped engagement hole 11 into which the driver 5 is to be fitted. The rotor 2 is further formed, on the outer side of the engagement hole 11, with a contact portion 12 bulging downward for contact with the arcuate portion 7*a* of the resistor film 7. To work the contact portion 12, a cut which is concentric with the rotor 2 may be formed in advance.

The holder 3 is designed to cover the rotor 2 from above and includes a pair of holding portions 13 bent to enclose opposite third side surfaces 1*c* of the insulating substrate 1 which adjoin the first side surface 1*a*. In this instance, each of the third side surfaces 1*c* of the insulating substrate 1 is formed with a second cutout 14 having a dimension which is generally equal to the plate thickness of the holder 3. Therefore, the outer surfaces of the holding portions 13 and the third side surfaces 1*c* of the insulating substrate 1 are generally flush with each other.

As shown in FIG. 4, the width of the second cutouts 14 is slightly larger than that of the holding portions 13 of the holder 3.

The holder 3 is formed with a window 15 for exposing the engagement hole 11 of the rotor 2, and a recess (stepped portion) 16 oriented downward in which the rotor 2 is rotatably fitted. The recess 16 is formed by press working. As clearly shown in FIG. 5, each of the holding portions 13 includes a lower lateral piece 13*a* bent into a mountain-like shape for line contact with the lower surface of the insulating substrate 1. (The electrodes 8 and 9 also include lower lateral pieces 8*b* and 9*b*, respectively, which are bent into a mountain-like shape.)

Either one or both of the two holding portions 13 of the holder 3 also function as a third electrode electrically connected to the rotor 2. As indicated by single-dot lines in FIG. 5, in mounting the resistor to a printed board 17, solder is applied to the holding portions 13. (The solder portions are indicated by reference sign 18.)

As the material for the electrodes 8 and 9, the rotor 2 and the holder 3, use may be made of a stainless plate, for example. To ensure good solderability, it is preferable that at least the outer surfaces of the electrodes 8, 9 and the holder 3 are plated with gold, for example.

The spacer 4 is made of an insulating resin such as Kapton tape and partially cut away to expose the contact portion 12 of the rotor 2. The spacer 4 may be bonded to the lower surface of the rotor 2 with e.g. an adhesive or simply placed between the rotor 2 and the resistor film 7. Although the spacer 4 is non-annular in the illustrated example, the spacer may be in the form of a ring including a hole for exposing the contact portion 12.

Alternatively, portion of the spacer 4 which corresponds to the movable range of the contact portion 12 of the rotor 2 may be cut away, and the spacer 4 may be fixed to the insulating substrate 1 with e.g. an adhesive.

To mount the holder 3 to the insulating substrate 1, either of the following two methods can be employed. In one of the methods, the holder 3 is laid over the insulating substrate 1 in the state before the lower lateral pieces 13*a* of the holding portions 13 are not formed by bending, and thereafter, the lower lateral pieces 13*a* of the holding portions 13 are formed. In the other method, the holder 3 in the state after the lower lateral pieces 13*a* of the holding portions 13 are formed by bending is fitted to the insulating substrate 1 by utilizing elastic deformation of the holding portions 13.

When the latter fitting method is employed, it is preferable to perform the fitting while elastically deforming the paired holding portions 13 to be away from each other by using a jig. In this case, damage to the resistor film 7 can be avoided. To mount the first and the second electrodes 8 and 9, the electrodes in which the upper and the lower lateral pieces 8*a*, 9*a*, 8*b*, 9*b* are formed by bending in advance are fitted against the resiliency.

Figure 6:
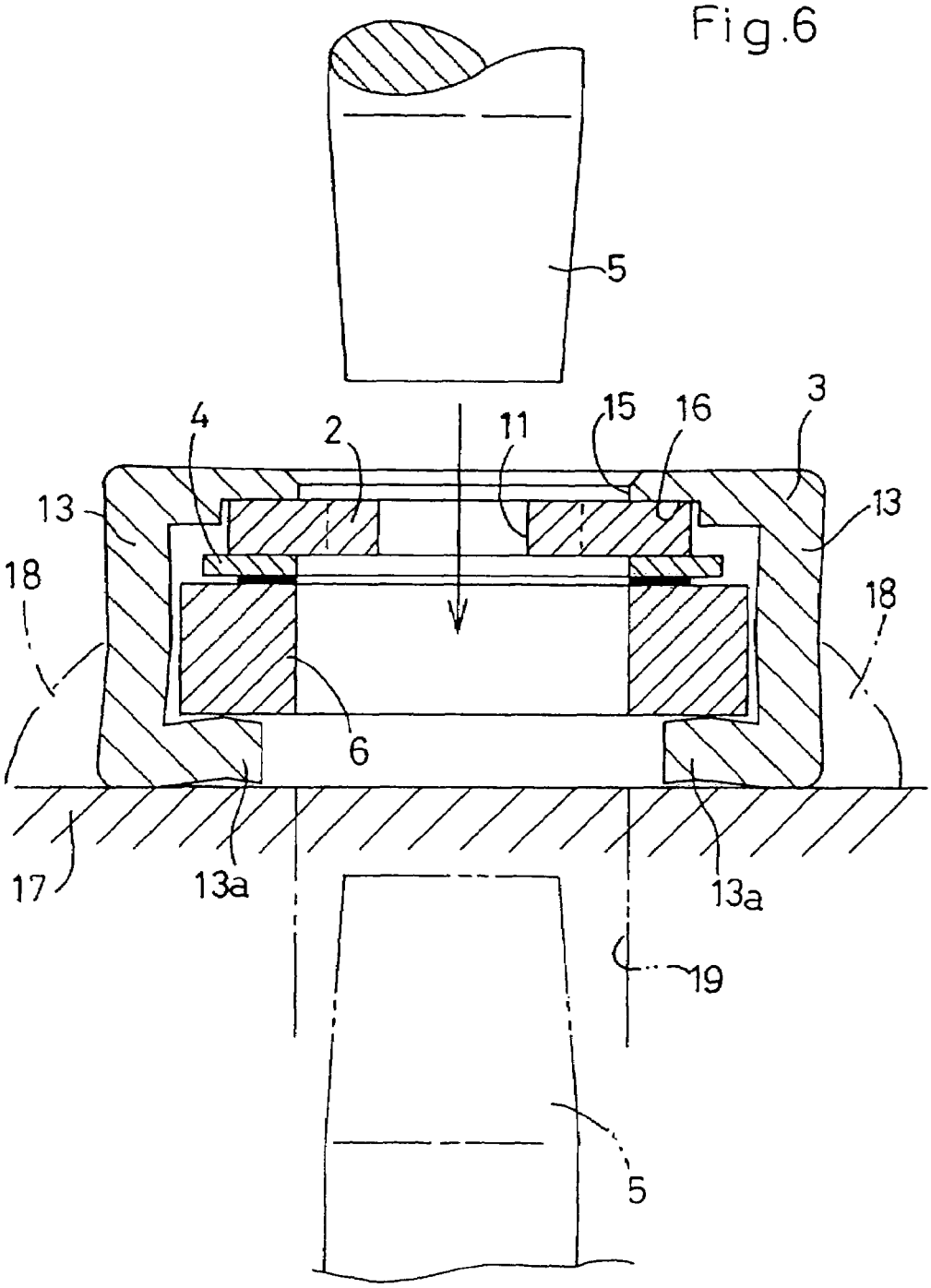
FIG. 6 is a sectional view taken along lines VI-VI in FIG. 4.

When the printed board 17 includes a through-hole 19 as indicated by single-dot lines in FIG. 6, the rotor 2 can be operated for rotation not only from the obverse side of the printed board 17 but also from the reverse side of the printed board 17 by inserting the driver 5 through the through-hole 19.

Like this embodiment, by forming cutouts 10, 14 for receiving the electrodes 8, 9 and the holder 3 at the side surfaces of the insulating substrate 1, the electrodes 8, 9 and the holder 3 do not project outward from the insulating substrate 1. Such a structure is advantageous for accurately correcting the posture in aligning or transporting the resistors by using a parts feeder or in picking up the resistors by using a collet.

By folding back the upper lateral pieces 8*a* and 9*a* of the electrodes 8 and 9, the upper surfaces of the electrodes 8 and 9 and the upper surface of the holder 3 can be made generally flush with each other even when the electrodes 8 and 9 are made of a metal plate. Therefore, the picking-up by a collet can be performed accurately.

Further, by forming the lower lateral pieces 13*a*, 8*b*, 9*b* of the holder 3 and the electrodes 8 and 9 into a mountain-like shape, a high elastic recovery force can be provided, whereby the holding power can be advantageously enhanced.

(2). Second Embodiment (FIGS. 7-9)

Figure 7:
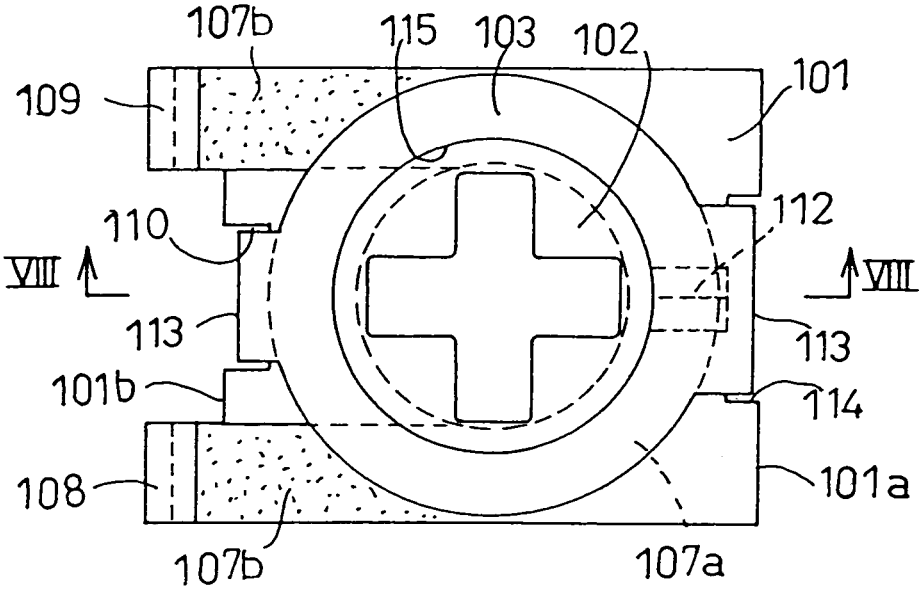
FIG. 7 is a plan view of a second embodiment.
Figure 8:
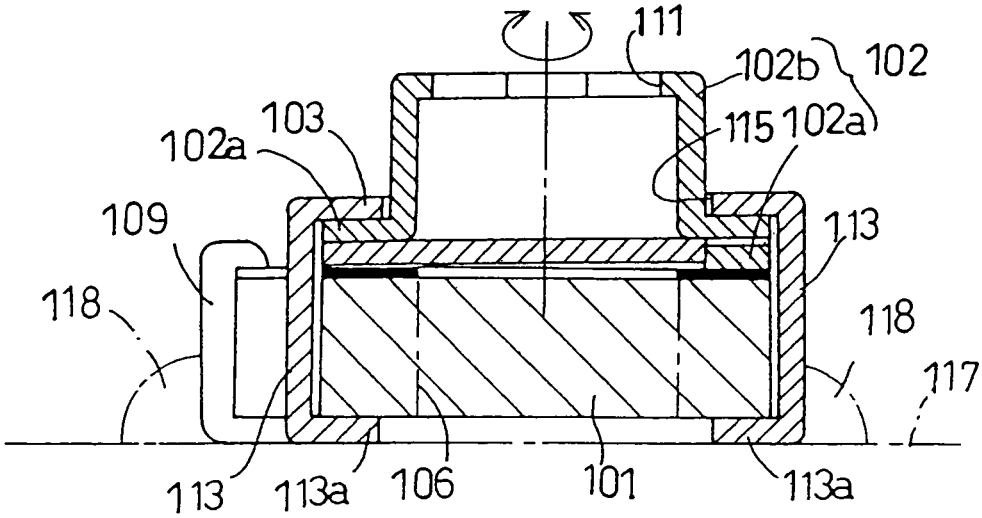
FIG. 8 is a sectional view taken along lines VIII-VIII in FIG. 7.
Figure 9A:
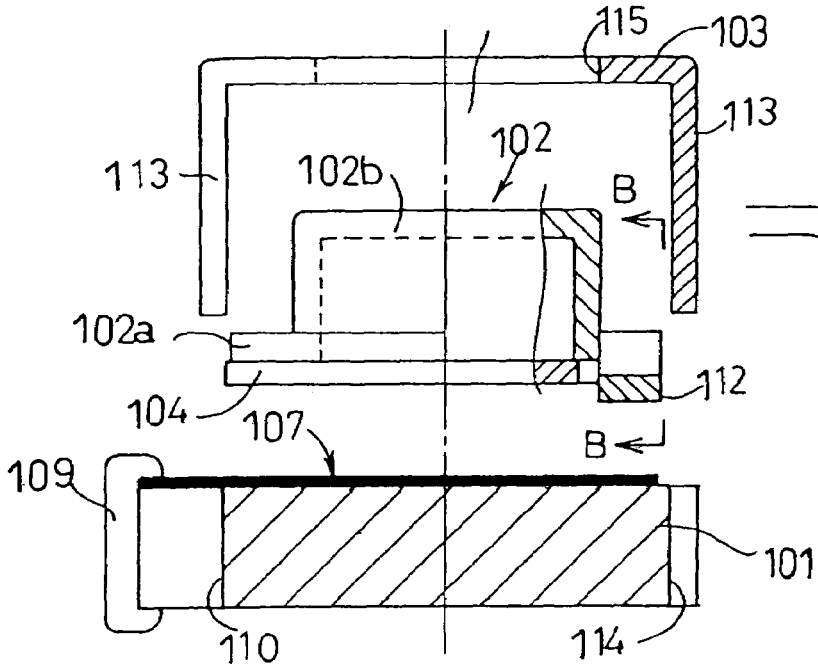
FIG. 9A is an exploded sectional view showing an intermediate step in the manufacturing process.
Figure 9B:
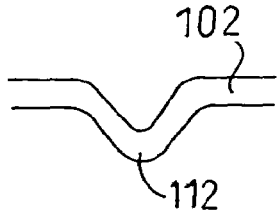
FIG. 9B is a view taken along lines B-B in FIG. 9A.

FIGS. 7-9 show a second embodiment.

In this embodiment, the rotor 102 comprises a flange portion 102*a* and an upward projection 102*b*, and hence, has a projecting shape in cross section. The top surface of the projection 102*b* is formed with an engagement hole 111. The holder 103 has a ring-like shape capable of overlapping the flange portion 102*a* of the rotor 102 and includes holding portions 113 extending to overlap the first side surface 101*a* and the second side surface 101*b* of the insulating substrate 101. The side surfaces of the insulating substrate 101 are formed with a first cutout 110 and a second cutout 114 for receiving the holder 103. The rotor 102 is formed with a window 115. The insulating substrate 101 is formed with a resistor film 107 including an arcuate portion 107*a* and linear portions 107*b*. The reference sign 118 indicates solder portions.

The holding portions 113 may initially have a shape extending straightly downward and may be bended to provide the lower lateral pieces 113*a* in mounting the holder to the insulating substrate 101. Alternatively, the downward lateral pieces 113*a* may be formed in advance by bending and then fitted to the insulating substrate 101 by elastically deforming the holding portions 113 to be away from each other.

The spacer 104 is in the form of a circular plate. However, the spacer may have a ring-like shape. (The spacer is formed with a cutout or a hole for exposing the contact portion 112 of the rotor 102.) The first electrode 108 and the second electrode 109 are made of conductive paste. However, the electrodes may be made of a metal plate.

This embodiment has an advantage that the resistor can be picked up by a vacuum collet. When the resistor is to be mounted on a printed board 117 formed with a through-hole 19 as shown in FIG. 6 of the first embodiment, it is preferable to form a through-hole 106 like that of the first embodiment in the insulating substrate 101 and form the spacer 104 into a ring-like shape.

(3). Third Embodiment (FIG. 10)

Figure 10:
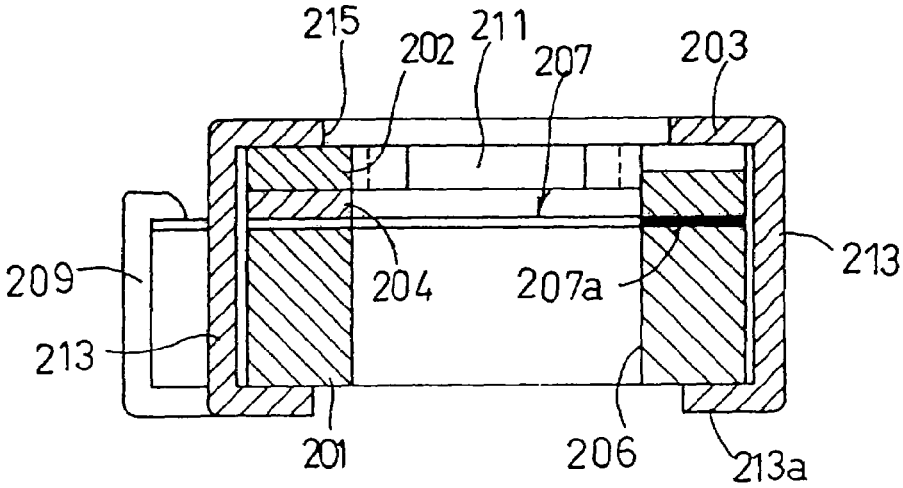
FIG. 10 is a sectional view of a third embodiment.

FIG. 10 is a sectional view of a third embodiment (which is the sectional view taken at the same portion as that of FIG. 8). This embodiment is like a combination of the first embodiment and the second embodiment. The rotor 202 is in the form of a circular plate similarly to the first embodiment, whereas the holder 203 has the shame shape as that of the second embodiment. The insulating substrate 201 is formed with a through-hole 206. The holding portions 213, the window 215, the lower lateral pieces 213*a*, the engagement hole 211, the resistor film 207, the arcuate portion 207*a*, the spacer 204 and the second electrode 209 in FIG. 10 have a function similar to those of the first and the second embodiments.

(4). Fourth Embodiment (FIGS. 11-12)

Figure 11:
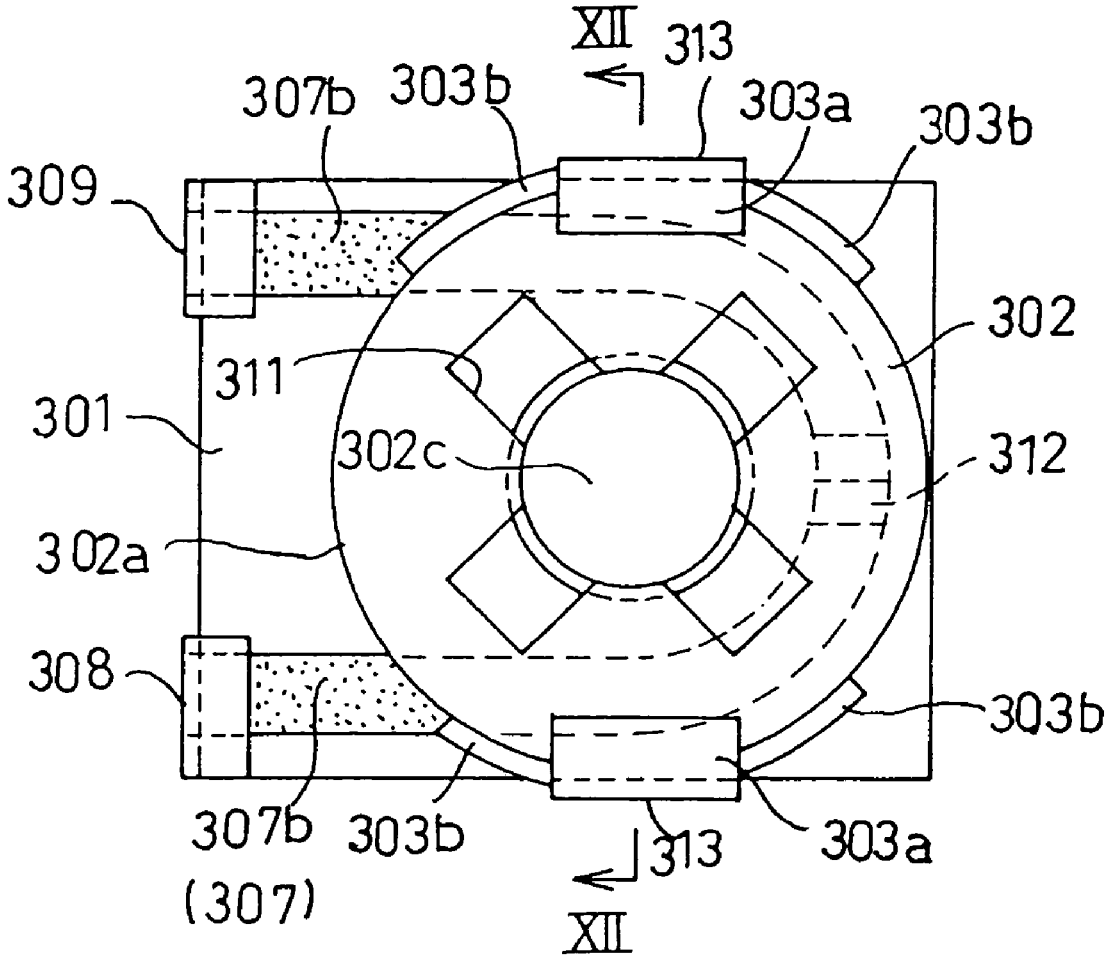
FIG. 11 is a plan view of a fourth embodiment.
Figure 12:
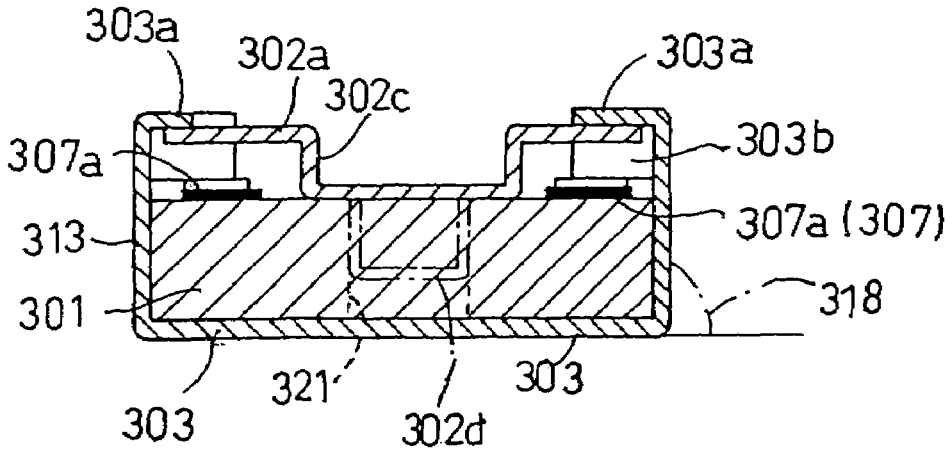
FIG. 12 is a sectional view taken along lines XII-XII in FIG. 11.

FIGS. 11-12 show a fourth embodiment.

In this embodiment, the rotor 302 comprises a bottomed cylindrical portion 302*c* which opens upward and is held in close contact with the insulating substrate 301, and a flange 302*a* connected to the upper surface. The flange 302*a* is formed with a contact portion 312 projecting downward.

The holder 303 is configured to extend over the lower surface of the insulating substrate 301. The holder 303 includes holding portions 313, a pair of holding pieces 303*a* lying on the flange 302*a* of the rotor 302, and a guide piece 303*b* which is arcuate in plan view and surrounds part of the rotor 302 from radially outward.

The flange 302*a* of the rotor 302 is floated above the resistor film 307 (arcuate portion 307*a*, linear portions 307*b*). In this embodiment, therefore, a spacer is not required. In this embodiment again, to prevent the holder 303 from moving, it is preferable that the insulating substrate 301 is formed with a cutout for receiving the holder 303.

As indicated by single-dot lines in FIG. 12, the insulating substrate 301 maybe formed with a through-hole 321 which is smaller in diameter than the bottomed cylindrical portion 302*c* of the rotor 302, and the bottomed cylindrical portion 302*c* of the rotor 302 may be formed with a downward projection 302*d* for fitting into the through-hole 321 of the insulating substrate 301. With such a structure, the posture of the rotor 302 is maintained by the through-hole 321, so that the holder 303 need not be provided with a guide piece. The engagement hole 311, the first electrode 308, the second electrode 309 and the solder portion 318 in the figure have a function similar to that of the first embodiment.

(5). Fifth Embodiment (FIG. 13)

Figure 13:
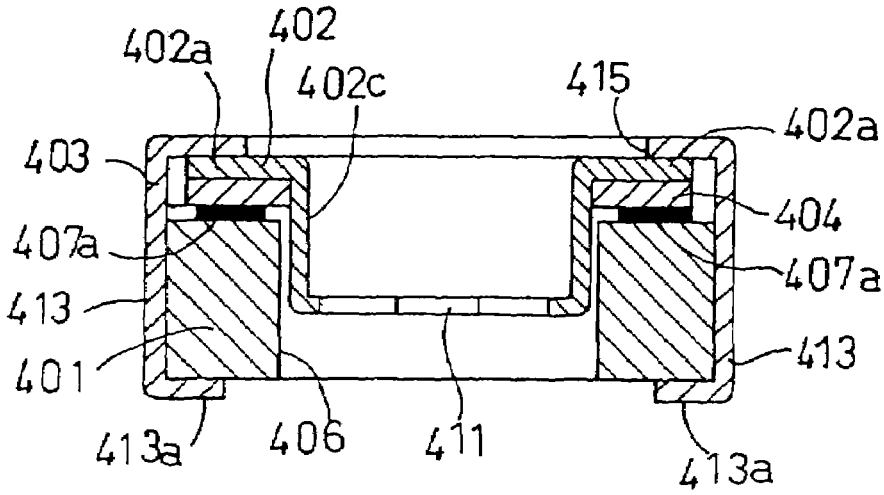
FIG. 13 is a sectional view of a fifth embodiment.

FIG. 13 shows a fifth embodiment. In this embodiment, the insulating substrate 401 is formed with a through-hole 406*c* capable of receiving a driver, whereas the rotor 402 is formed with a bottomed cylindrical portion 402*c* fitted into the through-hole 406. The bottomed cylindrical portion 402*c* is formed with an engagement hole 411.

In this embodiment again, the posture of the rotor 402 is maintained by the through-hole 406. Therefore, the holder 403 requires only the function to press the rotor 402.

The holding portions 413, the lower lateral pieces 413*a*, the window 415, the flange 402*a* of the rotor 402, the spacer 404 and the arcuate portion 407*a* of the resistor film have a function similar to those of the first through the fourth embodiments.

Specific examples of the present invention are not limited to the above embodiments but may be varied in various ways.

The invention claimed is:

1. A chip variable resistor comprising:

an insulating substrate having an upper surface formed with a strip-like resistor film;

a rotor overlapping the insulating substrate from above; and a holder held in electrical contact with the rotor for pressing, from an outside, the rotor in a horizontally rotatable manner;

wherein the resistor film has a non-linear configuration with an arcuate portion surrounding a rotation center of the rotor and with a first and a second ends extending toward an edge of the insulating substrate, wherein the rotor includes a contact portion for contact with the resistor film and an engagement portion to which a driver for rotational operation is to be fitted, the rotor being so held that only the contact portion comes into contact with the resistor film, wherein the resistor further comprises: a first electrode electrically connected to the first end of the resistor film; a second electrode electrically connected to the second end of the resistor film; and a third electrode electrically connected to the rotor, the first, the second and the third electrodes being exposed to the outside at a peripheral surface of the insulating substrate; and wherein the holder is formed from a conductive metal plate and comprises at least a pair of holding portions extending along an opposite pair of outer side surfaces of the insulating substrate onto a lower surface of the insulating substrate for attaching the holder to the insulating substrate and for pressing and holding the rotor, at least one of the holding portions serving as the third electrode.

2. The chip variable resistor according to claim 1, wherein the rotor comprises a conductive metal plate having a flat configuration and arranged to overlap the arcuate portion of the resistor film in plan view, and wherein the resistor further comprises a spacer made of an insulating material and intervening between the rotor and the resistor film for allowing only the contact portion of the rotor to come into contact with the resistor film.

3. The chip variable resistor according to claim 1, wherein the engagement portion of the rotor comprises an engagement hole in a form of a cross or a bar in plan view, and wherein the insulating substrate is formed with a through-hole for entirely exposing the engagement hole and for allowing insertion of the driver for rotational operation of the rotor via the through-hole.

4. The chip variable resistor according to claim 2, wherein the engagement portion of the rotor comprises an engagement hole in a form of a cross or a bar in plan view, and wherein the insulating substrate is formed with a through-hole for entirely exposing the engagement hole and for allowing insertion of the driver for rotational operation of the rotor via the through-hole.

5. The chip variable resistor according to claim 1, wherein each of the first and the second electrodes is made of a conductive metal plate into a configuration for clamping an edge of the insulating substrate from above and below.

6. The chip variable resistor according to claim 2, wherein each of the first and the second electrodes is made of a conductive metal plate into a configuration for clamping an edge of the insulating substrate from above and below.

7. The chip variable resistor according to claim 3, wherein each of the first and the second electrodes is made of a conductive metal plate into a configuration for clamping an edge of the insulating substrate from above and below.

* * * * *